US005788935A

United States Patent [19]

Furic

[11] Patent Number: 5,788,935

[45] Date of Patent: Aug. 4, 1998

[54] PROCESS FOR THE REGENERATION OF A SPENT SOLUTION FOR PICKLING ZIRCONIUM ALLOY ELEMENTS

[75] Inventor: Bernard Furic, Reze, France

[73] Assignee: Zircotube, Courbevoie, France

[21] Appl. No.: 590,864

[22] Filed: Jan. 24, 1996

[30] Foreign Application Priority Data

Jan. 24, 1995 [FR] France ..... 95 00783

[51] Int. Cl.[6] ..... C01G 23/00

[52] U.S. Cl. ..... 423/69; 423/DIG. 1

[58] Field of Search ..... 156/642.1; 423/69, 423/DIG. 1, 489; 23/305 R

[56] References Cited

U.S. PATENT DOCUMENTS

| | | | |
|---|---|---|---|
| 2,993,757 | 7/1961 | Dasher et al. . | |
| 3,540,513 | 11/1970 | Shinzo et al. | 159/2 |
| 4,144,092 | 3/1979 | Krepler | 423/DIG. 1 |
| 4,255,407 | 3/1981 | Puurunen | 423/DIG. 1 |
| 4,330,342 | 5/1982 | Fennemann et al. | 423/72 |
| 4,572,824 | 2/1986 | Kim | 423/70 |
| 4,937,054 | 6/1990 | Fennemann et al. | 423/72 |
| 5,076,884 | 12/1991 | Aguilar et al. | 423/85 |

FOREIGN PATENT DOCUMENTS

| | | |
|---|---|---|
| 374508 | 5/1984 | Austria . |
| 0331231 | 9/1989 | European Pat. Off. . |
| WO 91/14655 | 10/1991 | WIPO . |

*Primary Examiner*—Steven Bos

[57] ABSTRACT

A substantial part of the water contained in the spent solution is evaporated under vacuum in an evaporator (7) and is then condensed, so as to obtain slightly acidic water and a concentrated acidic solution polluted by zirconium fluoride $ZrF_4$. The polluted concentrated acidic solution is treated by evaporation under vacuum in a crystallizer (8), so as to obtain zirconium fluoride $ZrF_4$ crystals and a purified concentrated acidic solution. The slightly acidic water and the purified concentrated acidic solution are mixed in desired proportions in order to obtain a regenerated pickling solution.

4 Claims, 1 Drawing Sheet

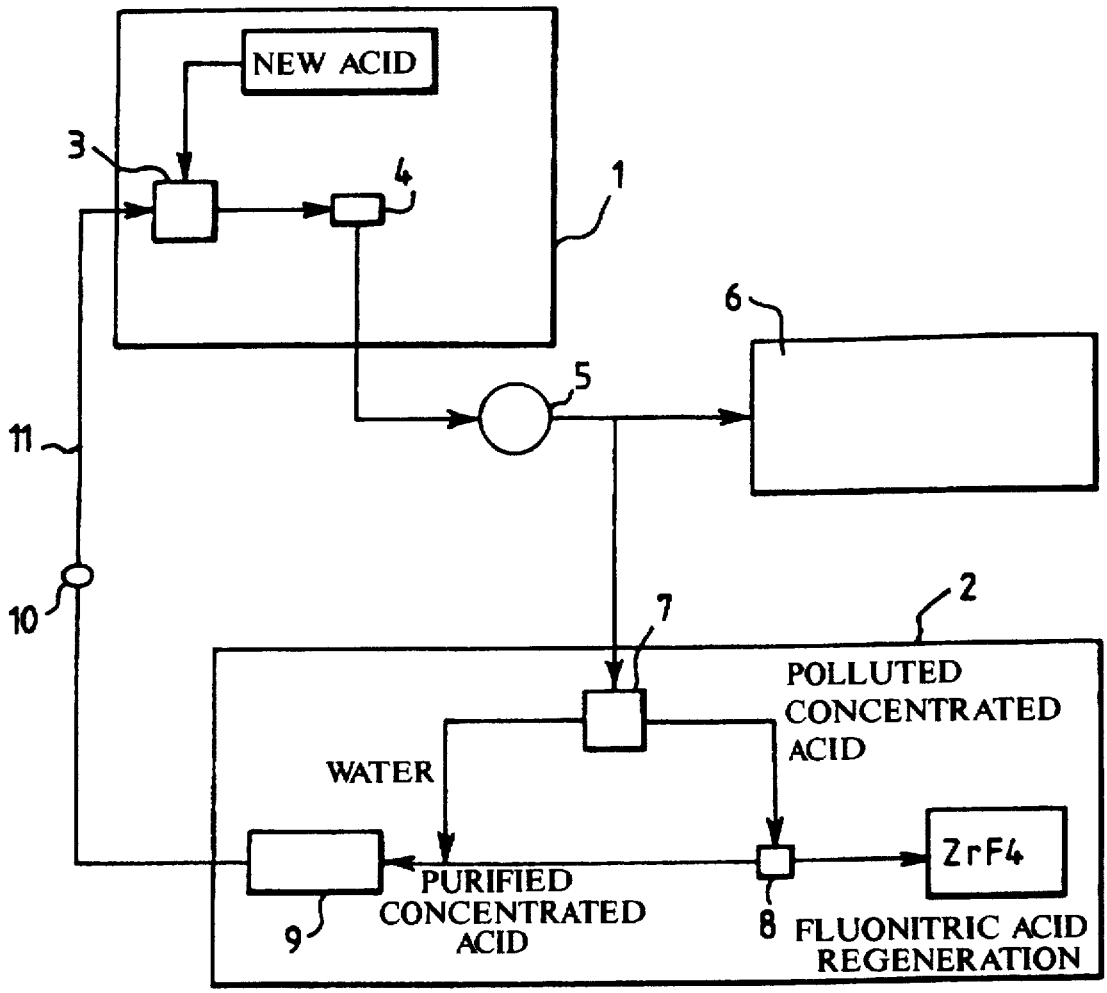
NEW ACID
3
4
1
6
5
11
10
7
2
POLLUTED
CONCENTRATED
ACID
WATER
ZrF4
PURIFIED
CONCENTRATED
ACID
9
8
FLUONITRIC ACID
REGENERATION

PROCESS FOR THE REGENERATION OF A SPENT SOLUTION FOR PICKLING ZIRCONIUM ALLOY ELEMENTS

FIELD OF THE INVENTION

The invention relates to a process for the regeneration of a spent acidic pickling solution used for the pickling of zirconium alloy elements.

BACKGROUND OF THE INVENTION

Fuel assemblies for a nuclear reactor and in particular fuel assemblies for a pressurized water nuclear, reactor generally consist of a bundle of parallel fuel rods held by a framework which includes longitudinal guide tubes and transverse spacer grids.

The fuel rods may consist of a zirconium alloy cladding into which fuel material pellets are introduced.

The guide tubes of the framework may also consist of zirconium tubes.

The manufacture of zirconium tubes from blanks requires several successive cold-rolling passes which are each followed by an annealing heat treatment.

Between each of the cold-rolling passes and the subsequent heat treatment, degreasing and chemical pickling of the rolled tube is carried out.

The chemical pickling of the tubes made of zirconium alloy such as Zircaloy 4 is carried out by using a solution of hydrofluoric acid HF containing a certain proportion of nitric acid $HNO_3$ used as a catalyst for the attack of the zirconium by the hydrofluoric acid, according to the chemical reaction $Zr+4HF \rightarrow ZrF_4+2H_2$.

The spent pickling solution, which is recovered in a storage tank after the pickling, mainly contains hydrofluoric acid, water and nitric acid as well as zirconium fluoride $ZrF_4$ which is formed during the pickling.

Baths for pickling zirconium alloy, which contain pollutant products, can be treated to separate most of the water in the solution from the polluting products which must be destroyed, in approved processing centers.

Zirconium alloy tube production units are therefore subjected to high costs relating to the separation and destruction of the polluting products in approved centers, as well as the purchase of fresh acids for reconstituting the pickling solution.

Furthermore, the destruction of spent acidic solutions produces nitrates which are discharged into the natural environment.

Transporting the spent solution to the processing center also entails the risks associated with the mode of transport of hazardous materials.

A process for the regeneration of solutions for pickling zirconium alloy may therefore be advantageous both economically and ecologically.

U.S. Pat.No. 5,076,884 and EP-A-0,331,231 disclose processes for the regeneration of solutions for pickling metals such as zirconium and hafnium. These processes use a precipitation reactant which is a sodium compound.

However, to date there has been no known process for the regeneration, without addition of a reactant, of a fluoronitric pickling solution used for the pickling of zirconium alloy elements such as cladding tubes or guide tubes of fuel assemblies for a nuclear reactor.

SUMMARY OF THE INVENTION

The object of the invention is to provide a process for the regeneration of a spent pickling solution consisting mainly of hydrofluoric acid, nitric acid and water, after use for the pickling of zirconium alloy elements, this process making it possible to reduce the operating costs of zirconium alloy element production lines, the discharge of polluting materials into the environment and the risks associated with the transport of hazardous materials.

To this end, according to the invention:

- a substantial part of the water contained in the spent solution is evaporated under vacuum and then condensed so as to obtain slightly acidic water and a concentrated acidic solution polluted by zirconium fluoride $ZrF_4$,
- the polluted concentrated acidic solution is treated by evaporation under vacuum in a crystallizer to produce, zirconium fluoride crystals $ZrF_4$ and a purified concentrated acidic solution, and
- the slightly acidic water and the concentrated acidic solution are mixed in the desired proportions in order to obtain a regenerated pickling solution.

BRIEF DESCRIPTION OF THE DRAWING

The single drawing figure is a block diagram showing the various successive operations employed for regenerating a spent fluoronitric acid solution used for the pickling of zirconium alloy tubes.

DESCRIPTION OF THE PREFERRED EMBODIMENT

In order to explain the invention more fully, a description will now be given, with reference to the appended drawing figure, of one embodiment of the regeneration process according to the invention.

The figure shows inside box 1, the operations conventionally employed in the context of a process for pickling by means of an acid solution and, inside box 2, the operations of regenerating a spent pickling solution after it has been used in the context of the normal process for pickling zirconium alloy tubes.

The conventional pickling process consists in preparing a fresh pickling solution, by mixing hydrofluoric acid, nitric acid and water in a desired quantity in a container 3 in order to obtain a high pickling efficiency. The pickling solution is used in a pickling unit 4 in which the zirconium alloy tubes are brought into contact with the pickling solution.

In the context of a process for the manufacture of cladding tubes or guide tubes for fuel assemblies for a nuclear reactor, three rolling operations are successively carried out on the tubular blanks, each operation being followed by an annealing heat treatment. Between each of the rolling operations and the subsequent annealing, degreasing and pickling of the tubular blanks or of the tubes is carried out using the fluoronitric mixture.

The chemical characteristics of the pickling solution are monitored and, when the solution no longer has the desired characteristics for sufficient implementation of the pickling process, the spent pickling solution is removed to a storage tank 5.

In the context of industrial implementation of the pickling process according to the prior art, the spent pickling solutions stored in a tank undergo destruction in an approved center, as represented by step 6, which is not implemented in the context of the regeneration process according to the invention.

The destruction of spent fluoronitric acid solutions in an approved center has the drawback of increasing the operating costs of the zirconium alloy tube manufacturing line, because of the costs of transport and processing for the destruction of the spent solution and the need to prepare a fresh acid solution from commercial products in the storage tank 3.

Furthermore, the process of destruction in an approved center is accompanied by production of nitrates, which must be discharged to the environment.

The regeneration process according to the invention, as shown inside box 2, is implemented by performing a separation treatment on the spent pickling solution stored in the tank 5.

The solution stored in the tank 5 mainly contains water, hydrofluoric acid and nitric acid, as well as zirconium fluoride $ZrF_4$ produced by the attack of the zirconium alloy tubes by the hydrofluoric acid, catalyzed by the nitric acid $HNO_3$.

The separation operations needed to regenerate the pickling solution by the process according to the invention are carried out successively in a vacuum evaporator 7 and in a vacuum-evaporator/crystallizer 8.

In order to implement the regeneration process industrially, the company ZIRCOTUBE used a vacuum evaporator marketed under the brand name WTSE 1000 by the company LED ITALIA and a WTSE 150 evaporator, of the same company, modified to withstand attack by concentrated acids and to constitute a crystallizer.

The vacuum evaporators used include an evaporation chamber in which a low pressure, for example of the order of 40 mm of mercury is maintained.

The solution to be treated in the evaporation chamber is introduced and maintained at a moderate temperature, for example of the order of 35° C.

The solution to be treated is heated by means of a heat pump.

The depressurization of the evaporation chamber makes it possible to separate, in vapor form, at least one of the constituents in the solution being treated, at a moderate temperature.

The vacuum evaporator includes a condensation stage in which the vapor separated from the solution to be treated is condensed.

The vacuum evaporator 7 and the evaporator/crystallizer 8 make it possible to obtain a distillate, which is condensed in a condensation stage, and a concentrate which remains in the evaporation chamber.

The vacuum evaporator 7, which may consist of a WTSE 1000 evaporator of the company LED ITALIA, makes it possible to evaporate and condense a large proportion of the water contained in the spent pickling solution which is introduced into the evaporation chamber of the evaporator 7 from the storage tank 5.

At the exit of the condensation stage of the vacuum evaporator, very slightly acidic and very slightly polluted water, which represents 70% by volume of the initial solution treated, is obtained. After evaporation of the water, a concentrated acid solution representing approximately 30% by volume of the initial pickling solution introduced into the evaporation chamber remains inside the evaporation chamber.

The concentrated acidic solution contains hydrofluoric acid HF, nitric acid $HNO_3$, a small quantity of water and a pollutant consisting of zirconium fluoride $ZrF_4$ produced by the acid attack of the zirconium alloy tubes during the pickling.

The concentrated acid solution could be sent in part or in full for destruction but, according to the process of the invention, it is preferred to carry out a second treatment of this concentrated solution in the crystallizer 8.

The crystallizer 8, which may be a vacuum evaporator operating according to the same principle as the vacuum evaporator 7, includes, inside its condensation chamber, a container which is lined with a material resistant to the concentrated acids and makes it possible to collect the $ZrF_4$ pollutant in the form of solid crystals.

The crystallizer 8 preferably includes a plastic lining in order to allow it to resist the action of acids in concentrated form.

Evaporation and separation of a concentrated acid solution containing substantially hydrofluoric acid, nitric acid and a very small quantity of water is carried out inside the evaporator/crystallizer, in the same way as in the evaporator 7. The concentrated acid purified by evaporation then condensed represents approximately 80% by volume of the polluted concentrated acid introduced into the crystallizer 8.

The purified concentrated acidic solution recovered in the condensation stage of the crystallizer 8 contains substantially all of the nitric acid in the initial pickling solution, because the nitric acid acts only as a catalyst during the pickling of the zirconium alloy.

At the end of the evaporation of the purified concentrated acidic solution, $ZrF_4$ crystals remain in the bottom of the crystallizer, constituting a dry extract representing approximately 20% by volume of the polluted concentrated acid solution at the start.

The purified concentrated acid obtained at the exit of the condensation stage of the crystallizer 8 is mixed with the slightly acidic water obtained at the exit of the condensation stage of the vacuum evaporator 7, in order to obtain a regenerated pickling solution which can be sent to the pickling solution storage tank 3.

The titre of the pickling solution is adjusted in a treatment unit 9 into which the concentrated acid mixture and water delivered at the output of the crystallizer 8 and of the evaporator 7 are introduced.

The titre of the solution can be reset, for example, by reintroducing pure water or fresh acid into the mixture, in the treatment unit.

The titre of the pickling solution is checked by a measuring unit 10 arranged on the line 11 for recycling the regenerated pickling solution into the storage tank 3.

The regenerated acid reaching the storage tank 3 is freed from all the polluting products formed during the pickling of the zirconium alloy tubes. Furthermore, the regeneration treatment according to the invention makes it possible to recover hydrofluoric acid from the spent pickling solution, and virtually all the nitric acid from the fluoronitric mixture. The use of large quantities of expensive fresh materials is thus avoided.

However, in order to avoid the phenomena of the concentration in the regenerated and recycled solution it is necessary to purge the regenerated solution regularly and to compensate for these purges by additions of a fresh fluoronitric acid solution.

The $ZrF_4$ crystals constituting a dry extract in the crystallizer can be extracted with ease because they are soluble in water.

Pure water is therefore introduced into the crystallizer, which makes it possible to dissolve the $ZrF_4$ crystals. The liquid obtained is withdrawn in order to empty the crystallizer. An acidic solution of $ZrF_4$ is obtained, in which the $ZrF_4$ can precipitate as soon as the pH of the solution reaches a value of approximately 5. The $ZrF_4$ can therefore be required from the aqueous solution by neutralizing this solution.

The zirconium fluoride $ZrF_4$ obtained as by product in the regeneration process can be used as a base product in some manufacturing processes.

If it is not possible to use the $ZrF_4$ produced by the regeneration process according to the invention, it can be separated from the aqueous solution on a filter such as a filter press and packaged, for example, in order to remove it to an underground storage center.

The process according to the invention makes it possible to reduce the operating costs of production units for zirconium alloy elements such as cladding tubes and to avoid the transport of spent pickling solutions comprising polluting products and the expensive processing of these spent solutions in specialized processing centers.

In order to separate the products from the spent solution, it is possible to use vacuum evaporators of a type other than those which were described above.

It is possible to carry out full recycling or only partial recycling of the spent treatment solution, and any type of installation may be provided for adjusting the composition of the regenerated solution and for reintroducing the regenerated solution in the zirconium alloy element pickling line.

The invention applies to the regeneration of any fluoronitric acid solution used for the pickling of zirconium alloy elements.

I claim:

1. A process for the regeneration of a spent pickling solution containing hydrofluoric acid, nitric acid and water, used for pickling zirconium alloy elements, said process comprising the steps of:

(a) evaporating under vacuum water of the spent pickling solution containing zirconium fluoride to obtain a concentrated acidic solution containing zirconium fluoride and vapor separated from the spent pickling solution;

(b) condensing the vapor separated from the spent pickling solution to obtain slightly acidic water;

(c) evaporating said concentrated acidic solution under vacuum in a crystallizer to obtain zirconium fluoride crystals deposited in the crystallizer and a purified concentrated acid, and condensing said purified concentrated acid;

(d) mixing the slightly acidic water and the purified concentrated acid to obtain a regenerated pickling solution; and (e) removing the zirconium fluoride crystals from the crystallizer and disposing of said crystals.

2. The process according to claim 1, comprising adjusting the titre of regenerated pickling solution by adding water to the purified concentrated acidic solution.

3. The process according to claim 1, comprising dissolving the zirconium fluoride crystals obtained in the crystallizer with water in order to remove them from the crystallizer.

4. The process according to claim 1, wherein evaporation of both the water of the spent pickling solution (step a) and of the concentrated acidic solution (step c) is carried out under a pressure of about 40 mm of mercury.

* * * * *